US005335003A

United States Patent [19]

Sugden

[11] Patent Number: 5,335,003

[45] Date of Patent: Aug. 2, 1994

[54] OPTICAL STENCIL

[75] Inventor: Peter G. Sugden, Cottingham, England

[73] Assignee: Coherent, Inc., Santa Clara, Calif.

[21] Appl. No.: 776,253

[22] PCT Filed: May 18, 1990

[86] PCT. No.: PCT/GB90/00779

§ 371 Date: Nov. 14, 1991

§ 102(e) Date: Nov. 14, 1991

[87] PCT Pub. No.: WO90/14642

PCT Pub. Date: Nov. 29, 1990

[30] Foreign Application Priority Data

May 19, 1989 [GB] United Kingdom ..... 8911619.8

[51] Int. Cl.[5] ..... B41J 2/435

[52] U.S. Cl. ..... 346/107 R; 354/106

[58] Field of Search ..... 346/108, 76 L, 107 R, 346/1.1; 354/106

[56] References Cited

U.S. PATENT DOCUMENTS 3,865,031 2/1975 Ku et al. ..... 346/75

4,323,317 4/1982 Hasegawa ..... 346/76 L

*Primary Examiner*—Mark J. Reinhart

*Attorney, Agent, or Firm*—Limbach & Limbach

[57] ABSTRACT

A variable optical stencil assembly has a plurality of discs (1) each of which discs (1) is of substantially equal diameter and comprises a plurality of windows (3) therein, disposed around the periphery thereof and each having a respective character or combination of characters or a set of characters therein. Each disc is rotatably driven about a respective axis of rotation by drive means (2). The assembly comprises not less than three discs (1) and not more than five discs (1) and each disc (1) overlaps with the other discs (1) at a central point between the axes of rotation, such that a window from each disc (1) is aligned with a window from each of the other discs.

11 Claims, 2 Drawing Sheets

| 1 | A | B | C | D | E | F |
|---|---|---|---|---|---|---|
| | X | | | | | |

OPTICAL STENCIL

The present invention relates to an optical stencil or mask for displaying information or data, and more especially to a variable optical stencil in which each of the characters or elements comprising the information or data displayed by the stencil can be varied.

Optical stencils are used in laser printing systems for non-contact printing of information or data, usually in the form of alpha-numeric characters. These systems have a wide range of applications, and by way of illustration they are commonly used for printing batch numbers, sell-by dates, serial numbers on the packaging of food products, household products and the like. As will be readily appreciated the unique nature of this information means that it is not usually possible to preprint it on the product packaging, and instead, it is printed on the product packaging at some point in the production process. In use, laser light is directed through the stencil and focussed onto a surface of the target object to be printed where the image displayed by the stencil is reproduced either by burning or by a photo-sensitive reaction to the incident laser light. As will be readily appreciated the size of the printed image is dependent upon the stencil and the focussing system used.

In many applications, including the one cited above the characters or elements comprising the information or data to be displayed by the stencil must be varied as, for example, to change the sell-by date to be printed on a new batch of food products. To this end variable optical stencils are known which comprise a plurality of independently driven discs, each of which carries around its periphery a full compliment of the characters or elements to be displayed at a particular position in the stencil. Each character or element lies in a respective window or cut-out in the surface of the disc and the characters from each disc all occupy a unique position in their window relative to that of the characters from the other discs. As such, when two or more discs are arranged relative to one another so as to superimpose a window from one disc with a window from each of the other discs, the characters in each of the superimposed windows are displayed as an information word. It should be readily apparent that by rotating any of the discs about their central axis the windows which are superimposed, can be changed and hence the characters displayed by the stencil can be varied.

By arranging four discs, each on the shaft of a respective drive motor into two pairs of discs, the two discs of each pair lying side by side with their adjacent edges overlapping and each pair of discs directly facing the other pair, a four character stencil is obtained. This arrangement is simple and uncomplex, and the number of moving parts is kept to a minimum because each disc is directly driven by its own drive motor.

However, should a variable stencil with more than four characters be required complications arise. One solution is to "pair up" each additional disc required to increase the number of characters in the variable stencil with one of the four original discs and drive each disc of the pair via belts or gears and coaxial drive shafts. Of course, this adds considerably to the cost and complexity of the variable stencil and also introduces other problems such as gear back lash introducing errors, and gear friction increasing the motor load.

Another solution is to use discs of differing diameters such that the disc hubs are accessible without recourse to hollow shafts. However, this creates other problems in that the large discs must be approximately twice the diameters of the small discs. A given angular position error will then be translated into a doubling of the character position error. Also, as the .angular moment of inertia of a disc is proportional to the square of its diameter the torque requirement to accelerate the disc is quadrupled.

In order to continuously determine the relative position of each disc it is known to provide each drive motor with a shaft mounted encoder. However, these have the disadvantage of being bulky and expensive. Furthermore, should the disc slip on the shaft this can not be detected.

As an alternative to providing shaft mounted encoders, each disc may incorporate its own encoder in the form of a series of unique patterns of slots, each of which is associated with a respective one of the characters on the disc and each of which extends radially from the centre of the disc. These slot patterns form a series of concentric rings in the disc, e.g. a 6-bit encoder would have six concentric rings. Whilst this arrangement is perfectly satisfactory in use, it does, however, greatly increase the cost of manufacture of each disc.

It is an object of the present invention to provide a variable optical stencil which allows up to ten discs to be used in a variable optical stencil without necessitating the use of an indirect drive to any of the discs.

It is a further object of the present invention to provide a disc for a variable optical stencil which incorporates it's own encoder and the fabrication of which is very much simpler compared to that of the known disc previously referred to.

According to the present invention there is provided a variable optical stencil assembly comprising a plurality of discs, each of which is of substantially equal diameter and comprises a plurality of windows therein disposed around the periphery thereof and each having a respective character or combination of characters of a set of characters therein, and drive means whereby each disc is rotatably driven about a respective axis of rotation, characterised in that there are not less than three discs and not more than five discs and each disc overlaps with the other discs at a central point between the axes of rotation, such that a window from each disc is aligned with a window from each of the other discs.

The discs are so arranged relative to one another as to ensure that their edges overlap at a central point without interferring with the drive means of each disc. To this end the distance between any two centres of rotation must be greater than the radius of the discs plus the diameter of the discs central hub. Alignment of the windows is ensured by appropriate selection of the angle of the windows on each disc relative to the radial line running therethrough.

In a preferred embodiment of the present invention the assembly comprises four discs which are arranged so that a square may be drawn between their respective axes of rotation. In this assembly the windows of each disc are preferably at an angle of 45 degrees to a radial line drawn through each one. However, the angle can be anywhere from between 0 degrees to 90 degrees, subject to the requirement that the angle of each window to the radial line therethough must compliment the angle of each window to the radial line therethrough of the disc diagonally opposite thereto, and the angle to the radial line of each window of each of the other discs must be equal to, but the negative of, the angle of each window of a respective one of the first two discs. In other words, consider the case where the windows of one disc are at 30 degrees to the radial lines passing therethrough. The windows of the disc diagonally opposite must be at 60 degrees to the radial lines passing therethrough, and the windows of the other two discs must be at −60 degrees and −30 degrees respectively to the radial lines passing therethrough.

Conveniently, the variable optical stencil further comprises resetting means whereby each of the discs can be returned to a datum position. Preferably, the resetting means comprises a datum slot formed in each disc and an optical sensor associated with each disc capable of detecting when the slot therein is aligned therewith.

The number of variable characters can be further increased without any need to provide complex co-axial drive arrangements by placing two of the assemblies according to the present invention face to face. Thus it is possible to have a variable optical stencil with anything from three to ten discs, each directly driven by its own drive means. In the unlikely event that yet more discs are required it would be necessary to resort to the use of co-axial drive shafts and similar arrangements.

In order to ensure that the optical sensors associated with each disc are able to detect the datum slot provided therein, each disc has a concentric ring of slots therein, the radius of which is equal to the distance from the axis of rotation of the datum slot carried by the facing disc. Thus when a datum slot is aligned with its optical sensor, the optical sensor will be able to "see" the datum slot through one of the slots in the concentric ring of slots in the facing disc.

In a preferred embodiment of the present invention the variable optical stencil assembly comprises encoder means whereby the position of each disc may be continuously determined, wherein the encoder means comprises a plurality of optical sensors associated with each disc which are radially equidistantly spaced from the centre of the said disc, and each disc comprises a concentric ring of slots formed at the same distance from the centre thereof as the optical sensors, the slots being so arranged that for any given position of the disc relative to the sensors a unique code is defined by the slots at the time in registry with the optical sensors and is detected by the optical sensors.

It should be apparent that the number of optical sensors determines the number of bits comprising the series of unique codes, each corresponding to a respective one of the positions of the disc. Because only a single ring of slots is required, substantial savings in space are achieved and fabrications of the discs is much simplified. aspect of the present invention may be used with the variable optical stencil according to the first aspect of the present invention or it may be used in a conventional variable optional stencil.

Embodiments of the present invention will now be described, by way of example, with reference to the accompanying drawings, in which.

Figure 1:
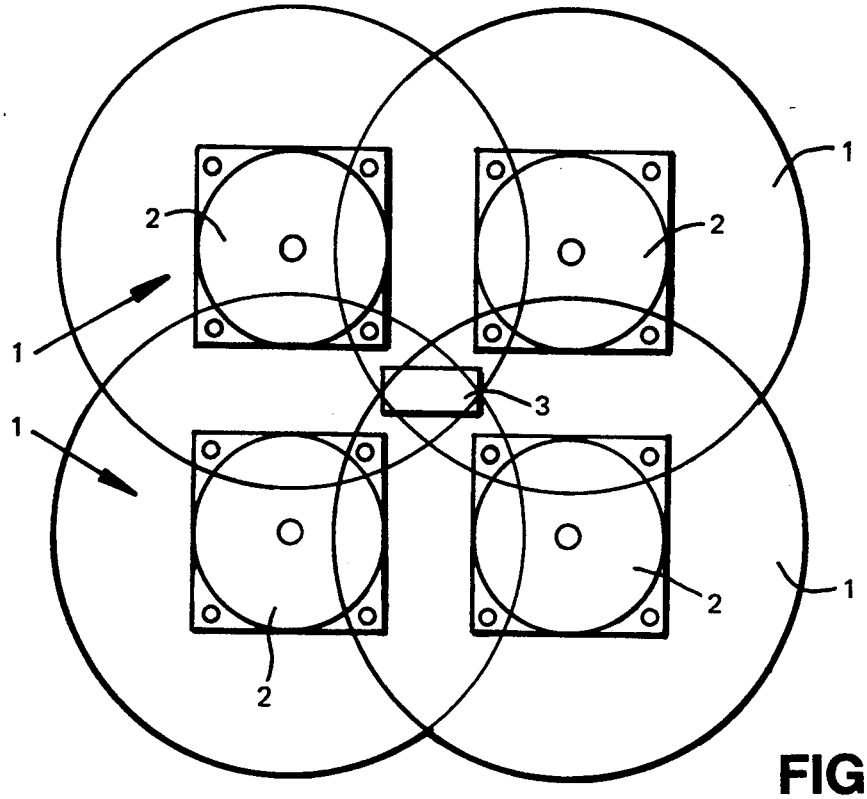
FIG. 1 shows a schematic view of a variable optical stencil assembly according to a first aspect of the present invention and which comprises four discs.
Figure 2:
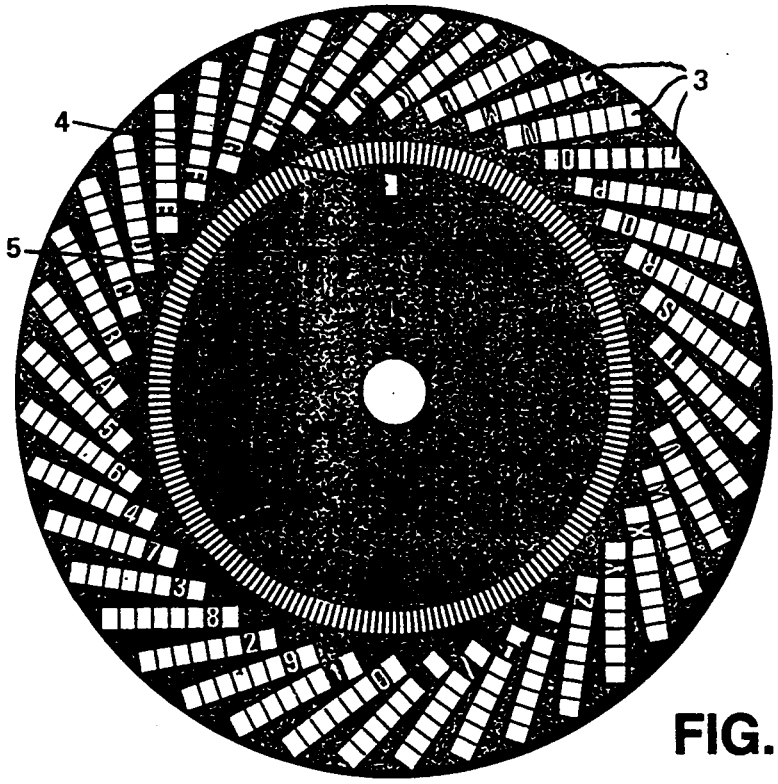
FIG. 2 shows a detailed plan view of a disc for use in an eight variable character optical stencil according to the present invention; and, FIG. 3 shows a plan view of a combination of a single disc and optical sensors from an optical stencil assembly according to a second aspect of the present invention.

Referring to FIG. 1 of the accompanying drawings there is shown a variable optical stencil comprising four discs 1, each of which is rotatably driven about its central axis by a stepper motor 2. The discs 1 are arranged so that the central axis of each one lies on the corner of a square drawn between the four central axes, and all four discs 1 overlap one another at the centre of this square. As shown in FIG. 2 a plurality of windows 3 are provided around the periphery of each disc 1 and within each window there is provided a particular character of a set of characters which are to-be used in the information displayed by the stencil. In the disc shown in FIG. 2 each character occupies the penultimate position of eight character spaces provided in the window and the disc is intended for use in an eight variable character stencil comprising a total of eight discs in all. In each of the other seven discs that would be used with this disc the characters occupy a respective position in this eight character space window. Each window 3 is arranged at an angle of 45 degrees to the radial line running through it from the centre of the disc. Thus, at the centre of the four disc assembly shown in FIG. 1, where the edges of the four discs overlap, a window from each disc 1 is aligned with a window from each of the other three discs 1, and a single character from each disc is visible in a respective position of the superimposed windows. By rotating any one of these four discs the character displayed at a particular position in the superimposed windows is varied.

An eight variable character stencil, using the disc shown in FIG. 2, and seven others is provided by placing two of the four disc assemblies shown in FIG. 1 face to face.

In use, it will occasionally be necessary to return each disc 1 to a datum position and to this end a datum slot 4 is provided in the surface of each disc 1, as shown in FIG. 2. In use, an optical sensor (not shown) is fixed ,in position relative to the disc 1 and by using the output of the optical sensor to regulate the disc drive motor 2 it is possible to stop the disc 1 with the datum slot 4 positioned in alignment with the optical sensor.

Where two variable optical stencils are used face to face, the datum slot 4 in each disc 1 will, of course, be obscured from the optical sensor associated therewith by the disc I directly facing it. In order to prevent this a concentric ring of slots 5 is provided in each disc 1. The radius of the ring 5 is equal to the distance of the optical sensor associated with the facing disc 1 from the centre of the disc 1 in which the ring is provided. Thus, regardless of the angular position of the disc 1 it will always be possible for the optical sensor associated with the facing disc 1 to "see" the datum slot in it through the ring of slots.

Though the discs 1 are shown arranged to form a square between their axes of rotation and the windows are at 45 degrees to the radial line running through each, other configurations are possible with the scope of the present invention. For example, the angle of the windows may be varied with respect to the radial line, provided that the windows of all four discs align at the point where the discs overlap. The discs need not form a square, though this is preferable. Any quadrangle in which the sides are greater in length than the radius of the discs plus the diameter of the central hub, but the distance between opposite corners is less than the diameter of a disc will enable the assembly to operate efficiently.

The present invention also envisages a five disc variable optical stencil assembly. The discs are so arranged that the central axis of each one lies on the corner of a pentagon drawn between the five central axes. The length of each side of the pentagon must be greater than the radius of each disc plus the diameter of its central hub, but the distance between any pair of opposite corners must be less than the diameter of each disc. Thus it is that the discs overlap at the centre of the pentagon. The windows in each disc are so arranged as to ensure that one window from each disc aligns with one window from each of the other discs at the centre of the area defined by the overlapping edges.

Should more than ten variable characters be required, these must be mounted on co-axial drive shafts in the same way as for a known optical stencil.

The control circuitry for the stepper motors is conventional and is not deemed to require detailed explanation herein.

Figure 3:
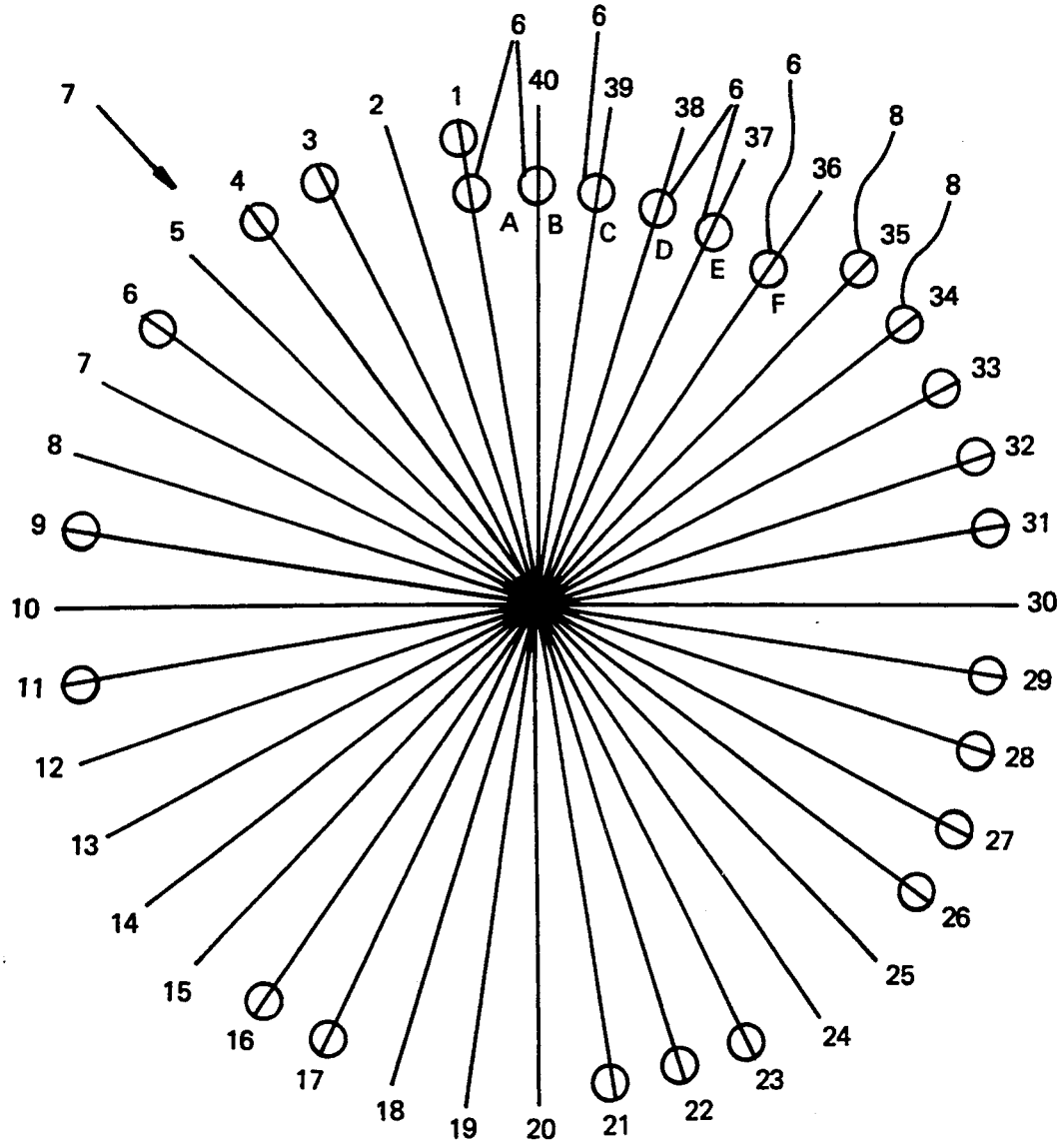

Referring now to FIG. 3 of the accompanying drawings there is shown a combination of optical sensors 6 and a disc (shown schematically) 7 for use in a variable optical stencil according to the present invention. As can be seen the disc. 7 has a plurality of slots or holes 8 in it which are all equidistantly spaced from the centre of the disc and which together define a concentric ring. The slots 8 are so arranged that, for each disc for each of the 40 possible positions relative to the six optical sensors 6 positioned adjacent thereto, a unique pattern is defined. This is sensed by the optical sensors 6 which are all equidistantly spaced from the centre of the disc by the same distance as the slots 8 (although for convenience of illustration the slots 8 are shown on a different radii from the optical sensors 6).

In the first position a single slot in the disc 7 is aligned with the first of the six optical sensors and the code read by the sensors is "100000". In the second position a single slot in the disc 7 is aligned with the second of the sensors 6 and the code read is "010000". Thus continuous position sensing is possible for each disc in the variable optical stencil.

I claim:

1. A variable optical stencil assembly comprising:

at least three discs each having a separate central axis, each disc being of substantially equal diameter, each disc including a plurality of windows disposed around the periphery thereof, each window having at least one character therein; and means for independently rotating each of said discs about the center axis thereof and wherein the center axis of the discs are spaced apart such that each said disc only partially overlaps each of the other discs at a central point between the axes of rotation of the discs in a manner such that the windows of each disc are aligned with the windows of the other discs.

2. A stencil as recited in claim 1 wherein each said disc includes a datum position and further including a means to return each disc to said datum position.

3. A stencil as recited in claim 1 wherein each said disc includes an aperture and further including an optical sensor located in a fixed position with respect to the disc for sensing the position of said aperture.

4. A stencil as recited in claim 1 further including at least one additional rotatable disc located in face to face relationship to one of the other discs and having a plurality of windows formed around the periphery thereof, each window having at least one character therein and wherein the window of the additional disc is aligned with the windows of the other discs.

5. A stencil as recited in claim 4 wherein each said disc includes an aperture and further including an optical sensor located in a fixed position with respect to the disc for sensing the position of said aperture.

6. A stencil as recited in claim 5 wherein each disc further includes a concentric ring of slots formed at a radial position with respect to the disc so that the slots are aligned with the aperture in the disc located in face to face relationship therewith to allow the optical sensor to sense the position of the aperture.

7. A stencil as recited in claim 1 wherein each disc includes a plurality of slots all located at a common radial distance from the central axis and at a plurality of axial positions and further including a plurality of optical sensors aligned with the radial position of said slots, with the slots being formed so that for any given angular position of the disc relative to the sensors, a unique code is defined by the slots and detected by the optical sensors.

8. A stencil as recited in claim 7 wherein said slots are located in various axial positions about the periphery of the disc and wherein said optical sensors are grouped together in an array, so that in various angular positions of the disc, less than all of the slots will be aligned with the optical sensors.

9. An optical encoder for a rotatable disc comprising:

a disc rotatable about a central axis, said disc having a plurality of slots all located at a common radial distance from the central axis and at a plurality of axial positions; and a plurality of optical sensors aligned with the radial position of said slots, with the slots being formed so that for any given angular position of the disc relative to the sensor, less than all of the slots will be aligned with all of the Sensors and a unique code is defined by the slots aligned with and detected by the optical sensors.

10. An optical encoder as recited in claim 9. wherein said optical sensors are grouped together in an array.

11. A stencil as recited in claim 1 wherein the distance between the central axis of any two discs is greater than the radius of the discs.

* * * * *